US005605525A

United States Patent [19]

Johnston

[11] Patent Number: 5,605,525

[45] **Date of Patent: *Feb. 25, 1997**

[54] TURNING EXERCISE APPARATUS

[76] Inventor: Gary L. Johnston, P.O. Box 183, Cowarts, Ala. 36321

[ * ] Notice: The term of this patent shall not extend beyond the expiration date of Pat. No. 5,441,472.

[21] Appl. No.: 501,313

[22] Filed: Jul. 12, 1995

Related U.S. Application Data

[63] Continuation-in-part of Ser. No. 234,544, Apr. 28, 1994, Pat. No. 5,441,472.

[51] Int. Cl.[6] ..... A63B 21/015

[52] U.S. Cl. ..... 482/118; 482/142

[58] Field of Search ..... 482/133, 134, 482/138, 142, 147, 114, 115, 118, 119; 601/27, 29, 31, 32, 33, 34

[56] References Cited

U.S. PATENT DOCUMENTS

| | | | |
|---|---|---|---|
| 4,773,398 | 9/1988 | Tatom | 482/139 |
| 5,179,939 | 1/1993 | Donovan et al. | 601/33 |
| 5,209,223 | 5/1993 | McGorry et al. | 601/34 |
| 5,441,472 | 8/1995 | Johnston | 482/142 |
| 5,474,520 | 12/1995 | Bittikofer | 601/27 |

*Primary Examiner*—Lynne A. Reichard

[57] ABSTRACT

A turning exercise apparatus comprising a structural frame means, a user engagement means, and optional resistance means and motor means, whereby the user may engage the user engagement means with their legs and/or feet, and perform lower body exercise routines while in a relatively reclined position. The user engagement means is turnably coupled to the structural frame means to turn in the forward, backward, and side directions. The user may manually produce motion in the user engagement means, with an optional resistance means included to provide a resistance force against the turning motion. An optional motor means may also be used to provide automatic turning motion of the user engagement means.

11 Claims, 11 Drawing Sheets

TURNING EXERCISE APPARATUS

CROSS REFERENCE OF RELATED APPLICATION

This application is a Continuation-In-Part of U.S. application Ser. No. 08/234,544, filed on Apr. 28,1994 now U.S. Pat. No. 5,441,472 and entitled "Pivoting Exercise Apparatus".

BACKGROUND OF THE INVENTION

1. Field of the Invention

The present invention relates to a turning exercise device. More particular, the present invention relates to an exercise device in which the user, while in a relatively reclined position on the device, engages the device with the lower body. The user may manually push, pull, and/or twist against the user engaged part of the device, whereby exercising routines may be developed which workout mainly the hip, stomach, buttocks, lower back, thigh, and calve areas. A resistance means may be included to provide a resistance force against the motion of the user. The device may alternatively utilize an automatic feature for inducing a push, pull, and/or twist motion upon the user.

2. Description of the Prior Art

Currently there exist many exercise devices for exercising the lower body muscle groups, specifically the stomach, hip, buttocks, lower back, thigh, and calve areas. However, most are suitable for mainly a specific group or possibly a combination of two. Some have proven uncomfortable to operate. For a good many people, especially women, the muscle groups which need the most exercise are in the aforementioned areas. This device uniquely addresses this problem.

There exist many devices upon which the user may sit or stand and perform a twisting exercise routine. This twist motion exercises mainly the stomach and lower back areas. Other devices exist upon which the user stands on one leg and engages a pad member with the thigh of the other leg, pushing against a resistance force with the engaged thigh. This works mainly the thigh and buttocks areas, but only one side of the body at a time is exercised. Some exercise devices allow the user to engage pad members with the inner and/or outer portion of the thigh, performing a type of exercise routine in which the user feels resistance as they pull their legs together or push their legs apart. This exercise routine works mainly the thigh and hip muscles, and for some people, is not very comfortable. Other exercise devices allow the user to engage a pad member with the thighs while in a reclined position, but the user may push only against the member, no pulling or twisting is possible. There are also exercise devices in which the user pushes against a foot support member with their feet, thereby exercising mainly the thigh and calve muscles.

Given that there are a vast number of exercise products for the lower body being sold today, it has come as a surprise that no one has effectively designed a device that can exercise all of the main lower body muscle groups at once, or a selected combination, all from the same device. The device in this specification provides this capability, in either a manual or automatic mode of operation. Both legs of the user are used to operate this device, not one at a time. This therefore cuts down on the required total exercise time. The user operates the device while in a reclined position, which should prove very comfortable for a lot of people, especially those older or disabled. This device is unique in that it provides for selectable twisting, pulling, and/or pushing motion in the lower body area.

SUMMARY AND OBJECTS OF THE INVENTION

The object of the present invention is to provide an exercise device in which the muscles of the lower body area, specifically the stomach, hip, buttocks, lower back, thigh, and calve areas, can be exercised simultaneously, or in some combination, as selected by the user. One version may allow for manual operation of the device with exercising motions in the described lower body muscles being induced by the user. A resistance means may be included so that the user feels a resistance force as the exercise routines are performed. A second version of the device may allow for automatic operation of the device, with exercising motion in the lower body area being induced by a motor means. These features allow for better, more comprehensive, and more versatile workouts than found on similar exercise devices.

Briefly stated, the apparatus that forms the basis of the present invention comprises basically a structural frame means, a user engagement means, and optionally a resistance means and motor means. The user positions themselves in a reclined position and engages the user engagement means with the lower body. The lower body may be supported at the front, back, and side positions of the general thigh and/or knee area, and may also be supported at the foot area by an optional foot support member. The user engagement means is coupled to the structural frame means to turn in a side to side motion, and to turn in a front to back motion, either together or separately, whichever is desired by the user. The optional resistance means may be used to provide for a resistance force against the user as they use their lower body to turn the user engagement means. An optional motor means may be used to create this turning motion in the user engagement means, thereby inducing motion in the user.

Also, a conventional exercise computer may be part of the apparatus. It will not be shown in the accompanying figures, but may connect to the user engagement means and/or the structural frame means to keep track of the exercise related data such as number of turns, elapsed time, calories, etc.

Other objects, features, and advantages for this invention will be apparent from the following detailed description and the appended claims, references being made to the accompanying drawings forming a part of the specification, wherein like reference numerals designate parts of several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
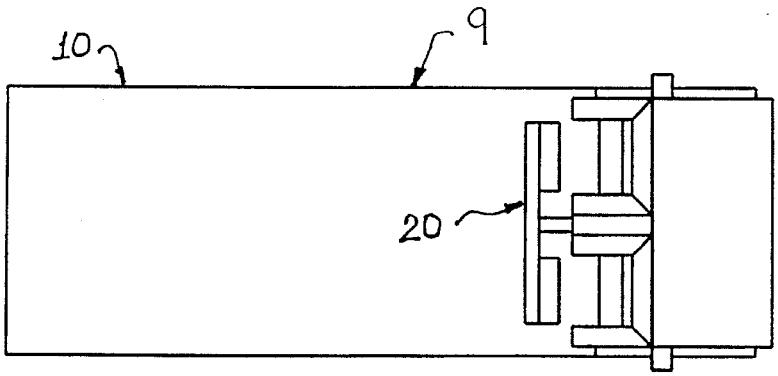
FIG. 1A is a top view of the turning exercise apparatus.
Figure 1B:
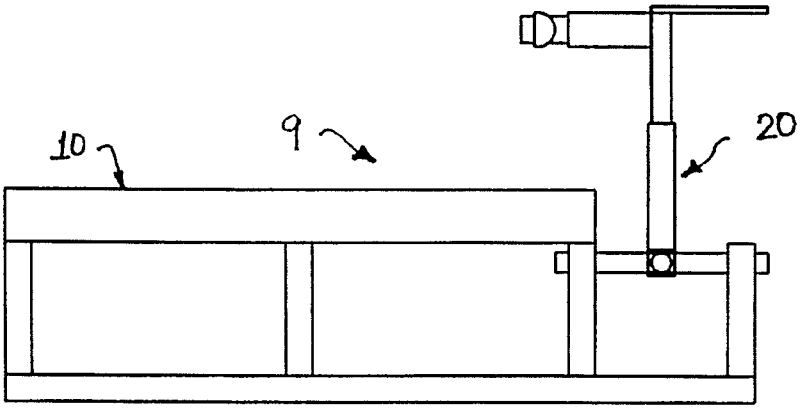
FIG. 1B is a side view of the turning exercise apparatus.
Figure 1C:
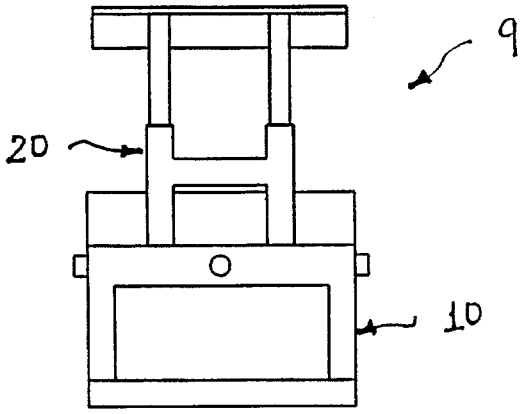
FIG. 1C is a front view of the turning exercise apparatus.

As best can be seen by references to the drawings, and in particular to FIGS. 1A, 1B, and 1C, the turning exercise apparatus that forms the basis of this invention is designated generally by the reference numeral 9. Turning exercise apparatus 9 comprises basically a structural frame means 10 and a user engagement means 20. Other features, such as a resistance means or a motor means, may be included in the apparatus for greater versatility.

Figure 2A:
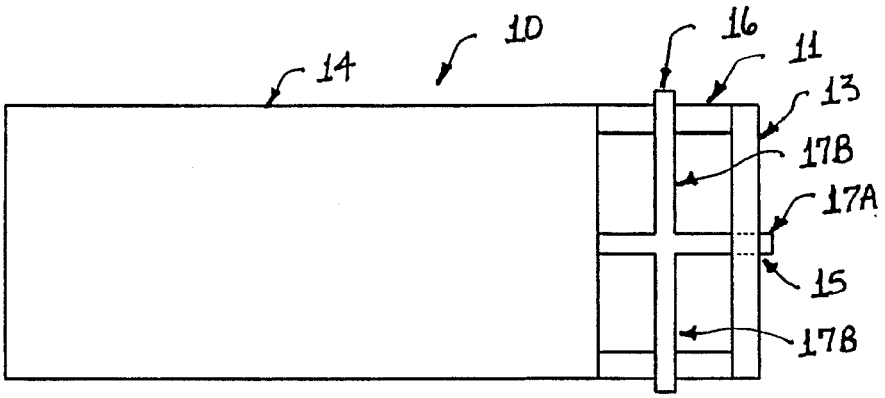
FIG. 2A is a top view of the structural frame means of the turning exercise apparatus.
Figure 2B:
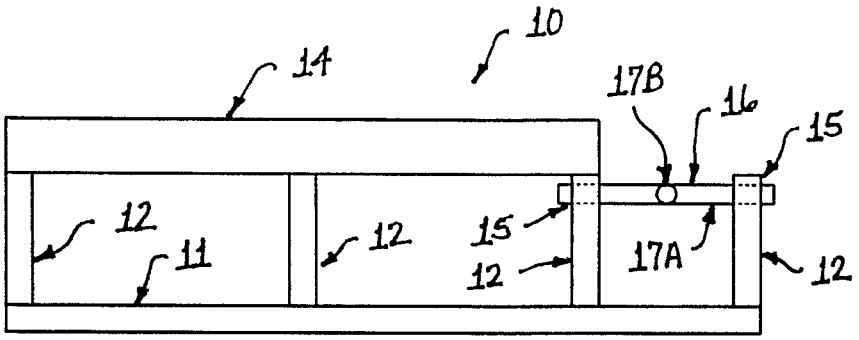
FIG. 2B is a side view of the structural frame means of the turning exercise apparatus.
Figure 2C:
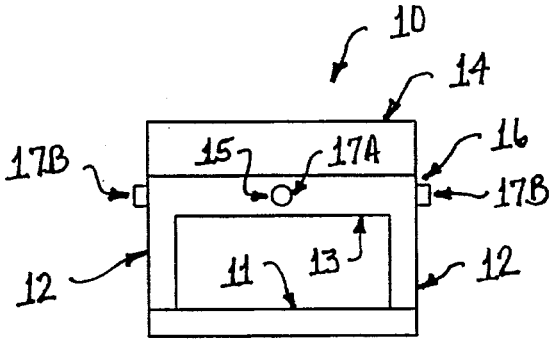
FIG. 2C is a front view of the structural frame means of the turning exercise apparatus.

Referring to FIGS. 2A, 2B, and 2C, the structural frame means 10 of the turning exercise apparatus 9 comprises basically a base 11, vertical frame supports 12, horizontal frame supports 13, back support means 14, and assembly support means 16. Base 11 is a generally rectangular structure from which vertical frame supports 12 extend upward along each side in pairs. Pairs of vertical frame supports 12 include one mounted on each side of base 11, both in the same relative plane. Horizontal frame supports 13 connect each pair of vertical frame supports 12. These horizontal frame supports 13 are used to support back support means 14 and assembly support means 16. Back support means 14 is used to support the user while in the generally reclined operative position. The two pairs of vertical frame supports 12 and the related horizontal frame supports 13, which are located towards the front of the device, are used to mount the assembly support means 16. The assembly support means 16 includes a main shaft-like member 17A with at least one shaft-like extension 17B rigidly mounted on the side, extending outward in a substantially perpendicular direction. Preferably, two shaft-like extensions 17B are use, each mounted on opposite sides of the main shaft-like member 17A, both extending outward in a substantially perpendicular direction with respect to main shaft-like member 17A. The extension should be in general alignment with one another. It would also be possible to utilize two shaft-like members, a first shaft-like member and a second shaft-like member, the second being rigidly mounted on top or bottom of the first, in a substantially perpendicular direction. The second shaft-like member may or may not extend outward on both sides, but preferably would. Each of two horizontal frame supports 13 used to support the assembly support means 16 has assembly openings 15 through which the main shaft-like member 17A of the assembly support means 16 turnably mounts. Collars may be placed on the assembly support means to keep it in proper position on the horizontal frame support and to keep the user engagement means 20 in proper position.

Figure 3A:
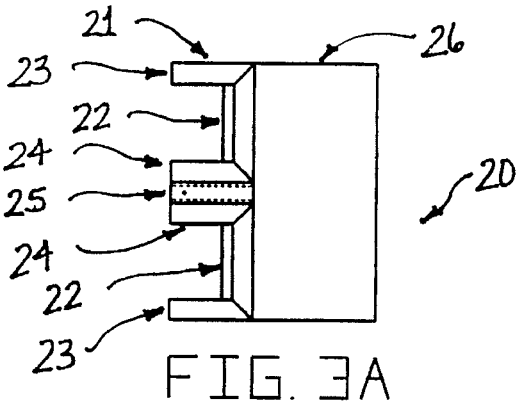
FIG. 3A is a top view of the user engagement means of the turning exercise apparatus.
Figure 3C:
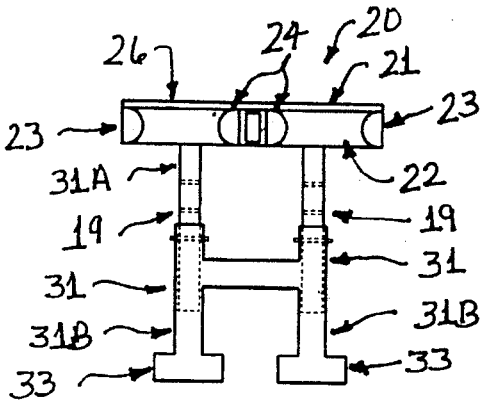
FIG. 3C is a front view of the user engagement means of the turning exercise apparatus.
Figure 3B:
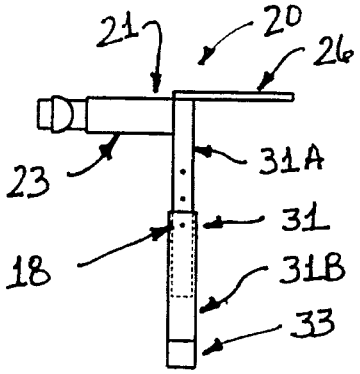
FIG. 3B is a side view of the user engagement means of the turning exercise apparatus.

As may be seen in FIGS. 3A, 3B, and 3C, the user engagement means 20 comprises an engagement member 21. Engagement member 21 includes back leg supports 22, outer leg supports 23, optional inner leg supports 24, and support sleeve member 25. Also, part of the user engagement means 20, as may be seen in FIGS. 3D, 3E, 3F, and 3G, is supplemental engagement member 27, which includes front leg supports 28 and support post member 29. The back leg support 22 and the front leg support 28 are used by the user when engaging the user engagement means 20 as turning occurs in the forward and backward directions. The outer leg supports 23 and optional inner leg supports 24 are used by the user when engaging the user engagement means 20 as turning occurs in the side to side direction. The inner leg supports 24 is considered optional because the user may use their own legs for inner support of one another, although having inner leg supports 24 should prove more comfortable. Preferably, the front, back, inner, and outer leg supports all have padded coverings.

Figure 3D:
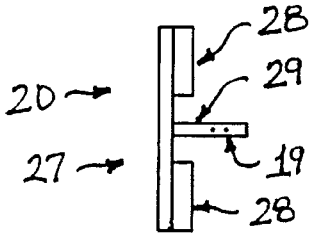
FIG. 3D is a front view of the supplemental engagement member of the user engagement means.
Figure 3F:
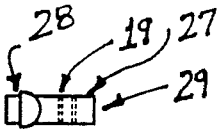
FIG. 3F is a side view of the supplemental engagement member of the user engagement means.
Figure 3G:
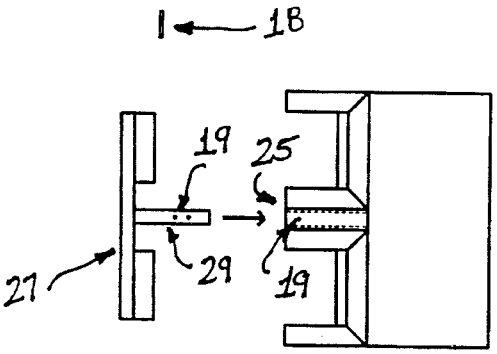
FIG. 3G demonstrates from the top view how the engagement member and the supplemental engagement member of the user engagement means mount together.
Figure 3E:
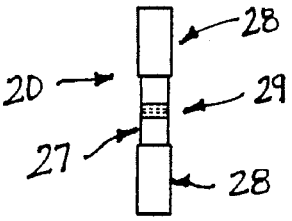
FIG. 3E is a top view of the supplemental engagement member of the user engagement means.

FIG. 3D demonstrates how supplemental engagement member 27 is mounted to engagement member 21. Supplemental engagement member 27 is required only when engaging the user engagement means in the forward to backward direction. It would not be required for engagement in the side to side direction, but should prove beneficial if used. As seen, engagement member 21 includes support sleeve member 25, mounted between the optional inner leg supports 24, into which support post member 29 of supplemental engagement member 27 moveably fits. If inner leg supports 24 are not used, the support sleeve members 25 may be at some other location, such as on the outside of the outer leg supports 23, and thus the location of the support post member 29 on supplemental engagement member 27 would change accordingly. Support post member 23 may have one or multiple vertical through holes 19. Support sleeve member 25 may also have one or multiple vertical through holes 19. Support post member 23 is placed within support sleeve member 25, the respective through holes 19 are then aligned, and a securing means, such as a bolt or pin, may then be placed through holes 19 to keep the post and sleeve member secure.

The engagement member 21 mounts to the structural frame means 10 through two vertical supports 31, which rigidly mount to engagement member 21 and extend downward in a substantially vertical direction. They then turnably mount to shaft-like extensions 17B of assembly support means 16 of structural frame means 10. One vertical support 31 could be used, but two should provide a more sturdy structure. Mounting to assembly support means 16 is through engagement sleeve members 33, which are rigidly mounted at the bottom of the vertical supports 31 and are positioned and sized to receive the shaft-like extensions 17B of assembly support means 16. A type of bearing, such as a roller or ball bearing, or low friction coating, may be used to allow easier rotation. Also, an optional cross support 32 may be used to connect the two vertical supports 31, which creates an even more sturdy structure. A calve support member 36 may be rigidly mounted to the top of engagement member 21. It is a substantially planar surface which extends in the generally forward direction and is used to support the calves of the user.

Figure 4A:
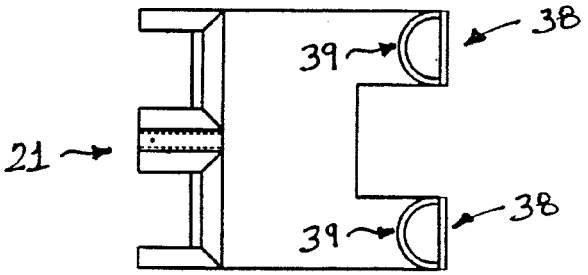
FIG. 4A is a top view of the user engagement means of the turning exercise apparatus having a foot support member.
Figure 4B:
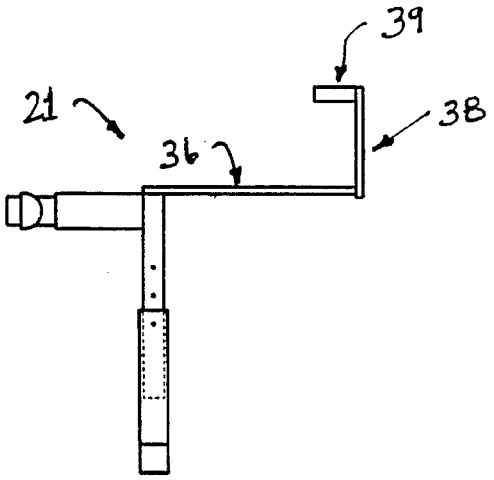
FIG. 4B is a side view of the user engagement means of the turning exercise apparatus having a foot support member.
Figure 4C:
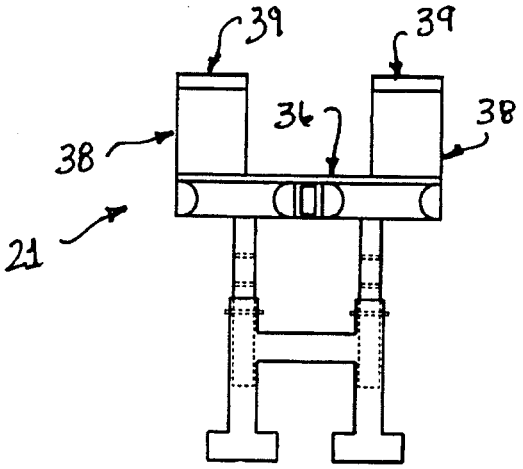
FIG. 4C is a front view of the user engagement means of the turning exercise apparatus having a foot support member.

In addition, an optional foot support member 38 may also be part of engagement member 21. This can be seen in FIGS. 4A, 4B, and 4C. It could be a relatively flat structure which attaches to the forward edge of the calve support member 36, and extends in a generally upward direction. The user would be able to push against foot support member 38 with their feet, thereby turning said user engagement means in the forward direction, and exercising mainly the thigh and calve areas. It would also be possible to add some type of top foot support, such as strap 39, to support the top of the feet so that the engagement member 21 may be pulled in the backward direction by the feet of the user, thereby again exercising mainly the thigh and calve areas.

The vertical supports 31 may also be divided into two components, 31A and 31B. Component 31A rigidly mounts to engagement member 21 while component 31B rigidly mounts to engagement sleeve member 33. Components 31A and 31B may be of tubular design, with component 31B being sized to loosely receive component 31A. Horizontal through holes 19 may exist in both components. Component 31A may be adjustably moved within component 31B, and the respective through holes 19 aligned. A securing means 18, such as a pin or bolt, may then be placed through the through holes 19. Similar methods may also be used to adjust the positions of the outer leg supports for different user leg widths, if deemed necessary. This feature allows the user engagement means to be adjusted for different user leg lengths. Leaving the pin or bolt out of the through holes may allow the components to automatically adjust for different user leg lengths and also possibly compensate for different engagement member positions.

Figure 5A:
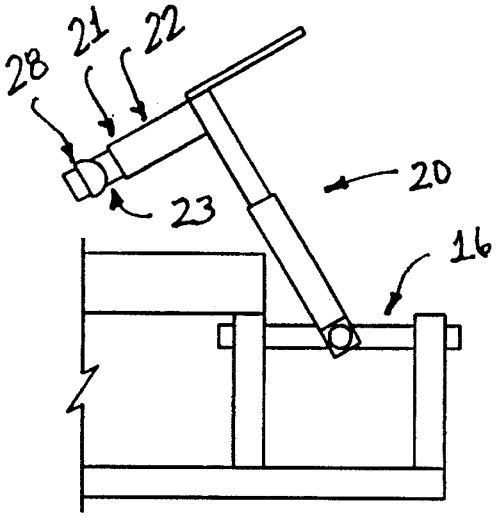
FIGS. 5A, 5B, and 5C demonstrates from a side view the different turning motions in the forward and backward direction by the user engagement means.
Figure 5B:
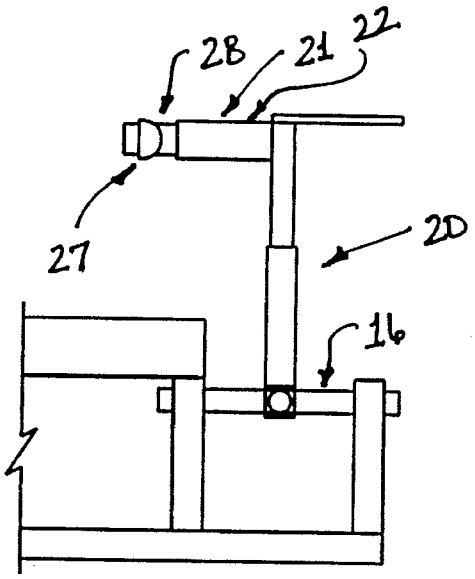
Figure 5C:
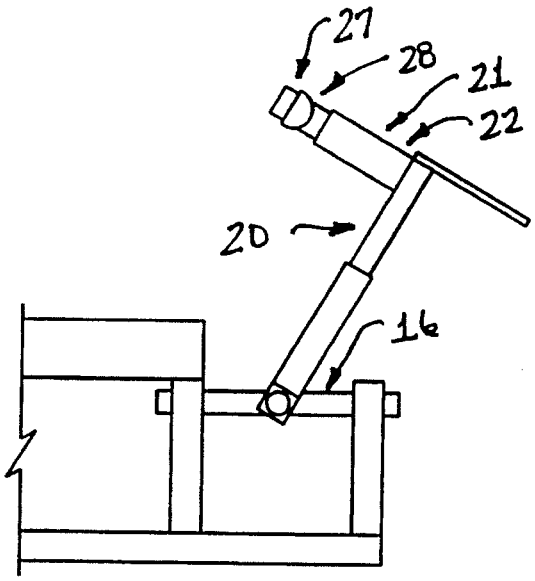

FIGS. 5A, 5B, and 5C demonstrate from a side view the turning motion of the user engagement means 20 in the forward and backward direction. The user may engage the user engagement means 20 with the lower body and produce forward motion by pushing against the back leg support 22 of the engagement member 21 with the back of their thigh and/or knee areas, or by pushing against the optional foot support member with the bottom of the feet. This causes turning movement in both the user engagement means 20 and the assembly support means 16 in the forward direction. The user may also pull back on the front leg support 28 of the supplemental engagement member 27 with the front of their thigh and/or knee areas. This produces backward motion in the user engagement means 20 and assembly support means 16. This exercise works mainly the thighs, stomach, and buttocks areas. Again, this backward motion may also be accomplished using the feet, if an optional top foot support is utilized.

FIGS. 5A through 5C demonstrate from a back view the turning motion of the user engagement means 20 in the side to side direction. The user may push against the outer leg support 23 of the engagement member 21 with the outer portion of one thigh and/or knee, while the inner portion of the other thigh and/or knee pushes against the optional inner leg support 24. This causes turning motion in user engagement means 20 about assembly support means 16, in one side direction. When the user pushes in the opposite direction, the user engagement means 20 turns about assembly support means 16 in the other side direction. The user may thus move the user engagement means 20 from one side to the other. This exercise works mainly the thighs, hips, and lower back areas.

As seen in FIGS. 5A–6C, the assembly support means is turnably mounted at its sides to the horizontal frame supports. The user engagement means thus turns about assembly support means when it moves in the side directions. It turns with the assembly support means in the forward and backward directions. It is possible to design the device so that the opposite is true. For example, the main shaft-like member of the assembly support means could be turnably mounted to the frame such that it turns in the side directions. In this case, the user engagement means could be constructed so that it turns with the assembly support means in the side to side directions, and turns about the assembly support means in the forward and backward directions.

In any case, the user may engage the user engagement means in either the forward, backward, right side, or left side directions, or some combination. Movement of the user engagement means may be user induced, and a resistance means may be used in conjunction to provide a resistance force against motion in any direction. Also, it may be possible to utilize a motor means for automatically producing the movement of the thigh engagement means. The optional resistance means and optional motor means will be discussed in detail later in the specification.

Figure 6A:
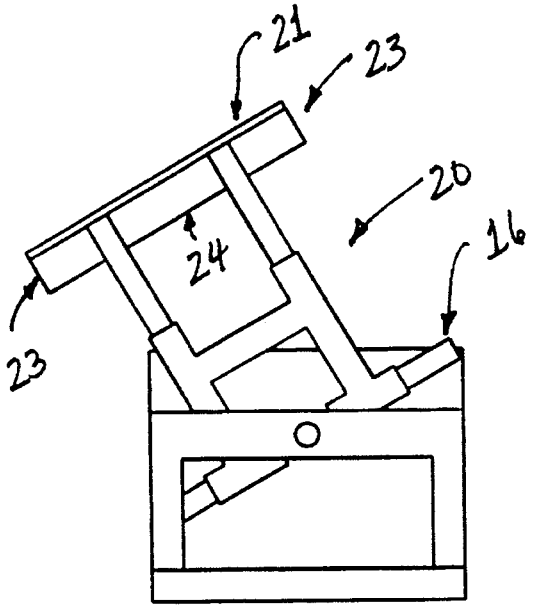
FIGS. 6A, 6B, and 6C demonstrate from the front view the different turning motions in the side to side direction by the user engagement means.
Figure 6B:
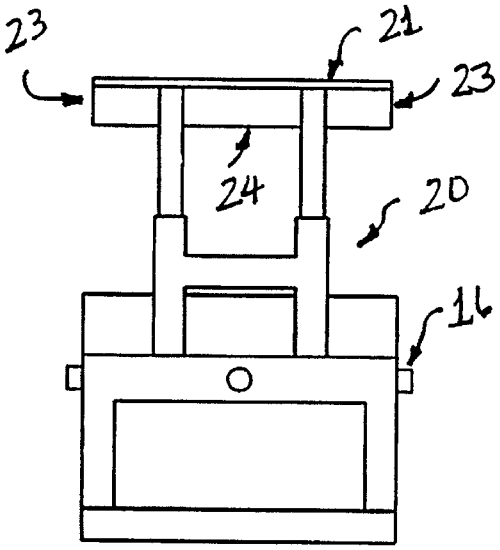
Figure 6C:
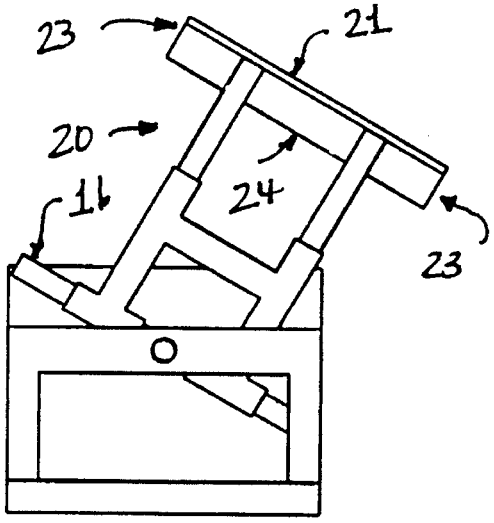
Figure 7A:
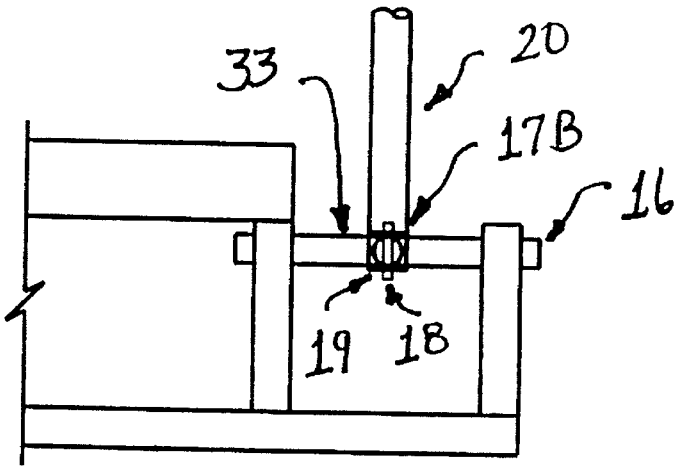
FIG. 7A demonstrates from the side view how the user engagement means may be adjusted to allow turning motion in the side to side direction only.
Figure 7B:
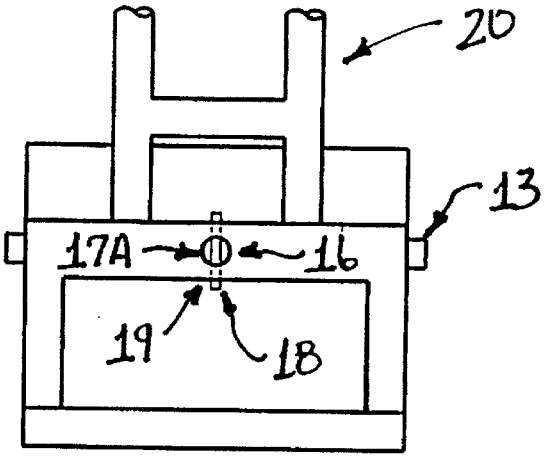
FIG. 7B demonstrates from the front view how the user engagement means may be adjusted to allow turning motion in the forward to backward direction only.

FIGS. 7A and 7B demonstrate from the front view how movement of the user engagement means 20 may be limited to either the forward and backward direction, or to the side to side direction. As seen in FIG. 6A, the shaft-like extensions 17B of assembly support means 16, upon which engagement sleeve member 33 mounts, may contain a vertically extending through hole 19. A vertically extending through hole 19 may also be part of the engagement sleeve member 33. The user may align these through holes and insert a securing means 18, such as a bolt or pin. This prohibits the user engagement means 20 from turning about assembly support means 16 in the side directions. Several through holes 19 may exist in the shaft-like extensions 17B, each at a different angle, so that user engagement means 20 may be secured at different angles. The user engagement means 20 would thus be able to move only in the forward and backward directions. In FIG. 6B, one of the horizontal frame supports 13 may have a vertically extending through hole 19. It can be aligned with a similar vertically extending through hole 19 found in main shaft-like member 17A of assembly support means 16, at the portion supported by the horizontal frame supports 13. A securing means 18, such as a pin or bolt, may then be placed in the aligned holes to prohibit motion of the user engagement means 20 in the side to side direction. Several through holes 19 may exist in main shaft-like member 17A, each at a different angle, so that user engagement means 20 may be secured at different angles. The user engagement means 20 would thus only be able to move in the side directions. Without the securing means, the user would be able to move the user engagement means in any direction. Various means, such as stops or blocks, may also be used to limit the degree of movement of the user engagement means.

Figure 8A:
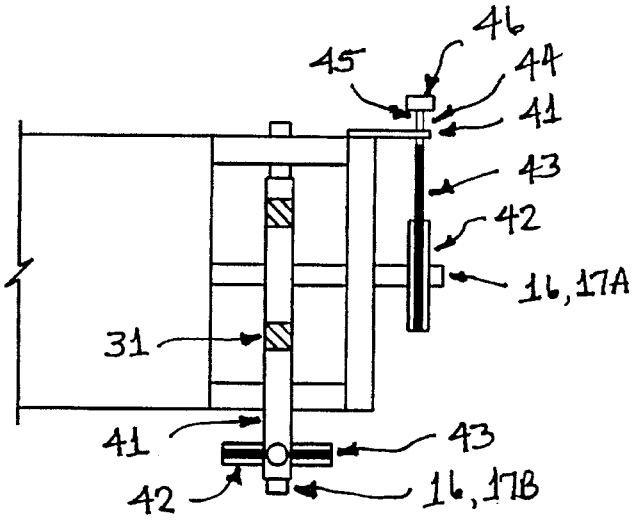
FIGS. 8A, 8B, and 8C demonstrate from the top, side, and front views, respectively, the mounting of a resistance means to the structural frame means and to the user engagement means to provide resistance force against the motion of the user engagement means.
Figure 8B:
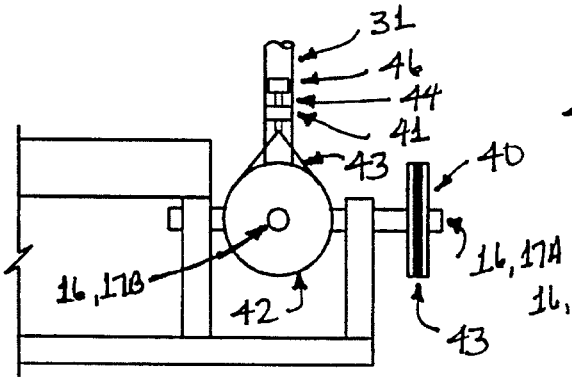
Figure 8C:
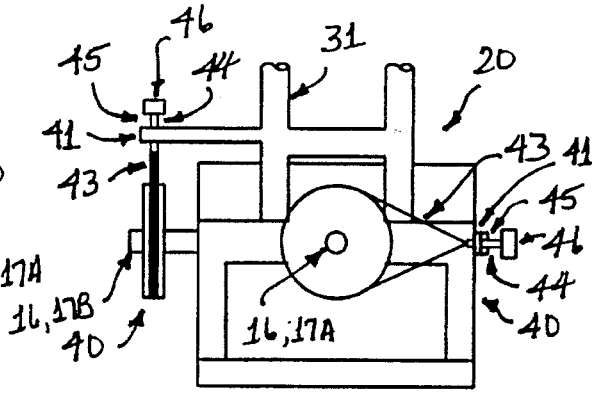

FIGS. 8A, 8B, and 8C demonstrate from the top, side, and front views, respectively, the mounting of a resistance means 40 to the assembly support means 16 and to the user engagement means 20, in order to provide resistance forces against the motion of the user engagement means 20. As seen, resistance means 40 may be a commonly seen type of resistance device. It may include a resistance mount 41, circular member 42, friction belt 43, externally threaded shaft 44, internally threaded opening 45, and knob member 46. In this case there are two resistance 40, one for providing a resistance force against the user engagement means 20 as it moves in the forward and backward direction, and a second for providing resistance in the side to side direction. There are ways to have one resistance means control the resistance forces exerted in both directions, but having two allows for greater flexibility.

With regards to the resistance means 40 which provides resistance in the backward and forward directions, the resistance mount may mount to the vertical support 31 of user engagement means 20. Resistance mount 41 has an internally threaded opening through which an externally threaded shaft 44 turnably mounts. A knob member 46 rigidly mounts to the top of threaded shaft 44 for use by the user in turning threaded shaft 44. Circular member 42 would rigidly mount to the shaft-like extension 17B of assembly support means 16. A friction belt 43, which may be an endless belt, loosely connects to the bottom end of threaded shaft 44 and also extends around at least a portion of the periphery of circular member 42. Therefore, as user engagement means 20 is moved in the forward and backward direction, the friction belt 43 will move along the periphery of circular member 42. This is due to the fact that the resistance mount 41 is rigidly mounted to vertical support 31 and will move accordingly, and because circular member 42 is rigidly attached to shaft-like extensions 17B of assembly support means 16, and will therefore remain stationary.

For side to side resistance motion, the resistance means 40 includes similar components, but the mounting will be different. The resistance mount 41 will mount to the horizontal frame support 13 of structural frame means 10. Circular member 42 will rigidly mount at the forward end of the main shaft-like member 17A of assembly support means 16. Therefore, as main shaft-like member 17A turns, so will circular member 42, but the friction belt 43 will remain stationary because resistance mount 41 remains stationary. The amount of force exerted against each circular member 42 by the corresponding friction belt 43 will correspond to the amount of resistance encountered by the user as they move user engagement means 20 in the forward and backward direction and/or side to side direction. The amount of force exerted by friction belt 43 may be adjusted through knob member 46. When knob member 46 is turned in one direction, threaded shaft 44 will turn accordingly and move upward, causing friction belt 43 to tighten against circular member 42, thus increasing the resistance force. Upon turning the knob member 46 in the opposite direction, the belt will loosen and therefore the resistance force will decrease.

Figure 9A:
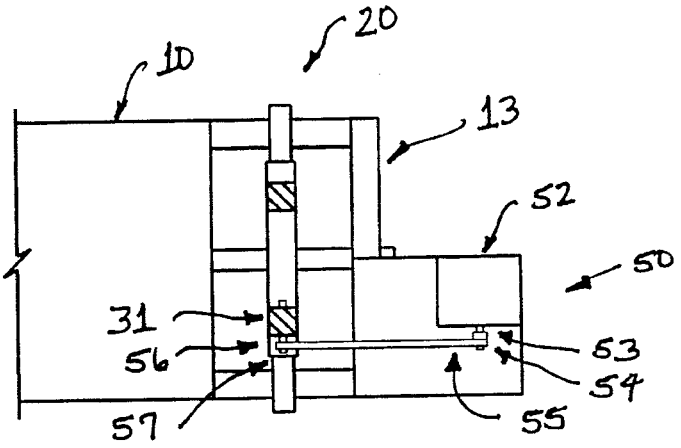
FIGS. 9A, 9B, and 9C demonstrate from the top, side, and front views, respectively, the mounting of a motor means to the structural frame means and to the user engagement means to provide automatic motion of the user engagement means in the backward and forward direction.
Figure 9B:
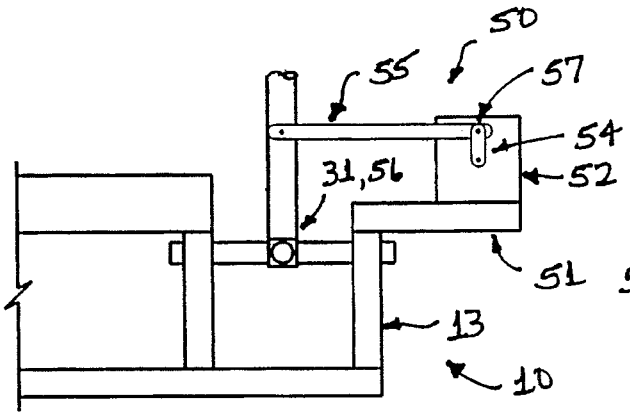
Figure 9C:
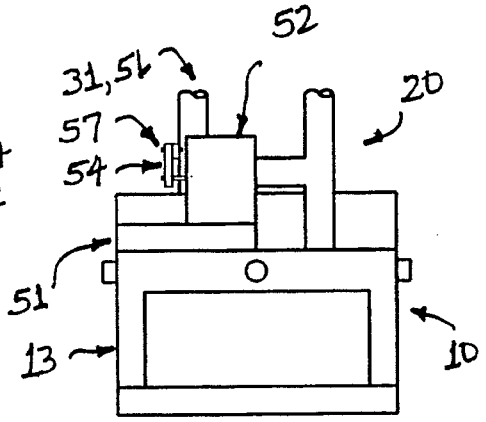

FIGS. 9A, 9B, and 9C demonstrate from the top, side, and front views, respectively, the mounting of motor means 50 to the horizontal frame support 13 of the structural frame means 10, and to the vertical support 31 of the user engagement means 20. This is to provide automatic motion of the user engagement means 20 in the backward and forward direction. Motor means 50 may include a motor mount 51, a motor 52 with motor shaft 53, and a typical rocker-crank linkage assembly comprising a crank link 54, a coupler link 55, and a rocker link 56. In this case, rocker link 56 and vertical support 31 are the same. The links may be pivotally connected together using linkage connectors 57, which may be a type of pin connection. The motor 51 may be of any conventional type, preferably electric. As seen, crank link 54 is rigidly mounted to motor shaft 53, and will rotate as motor shaft 53 rotates. Coupler link 55 pivotally connects the crank link 54 and the rocker link 56 through linkage connectors 57. Therefore, as motor shaft 53 rotates, so will crank link 54 as crank link 54 rotates, rocker link 56 will rock backward and forward, producing backward and forward turning motion in thigh engagement means 20.

Figure 10A:
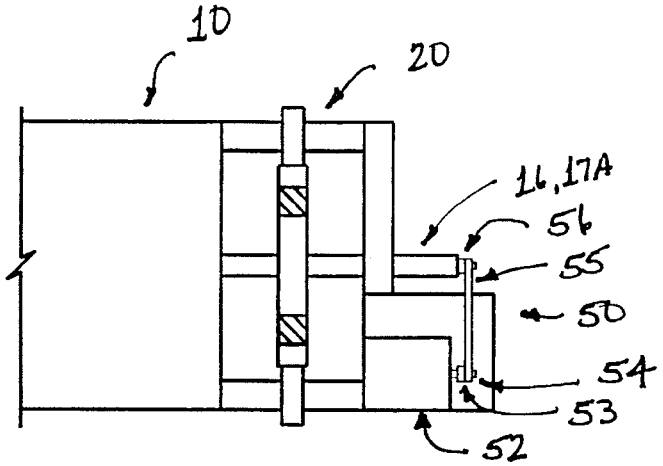
FIGS. 10A, 10B, and 10C demonstrate from the top, side, and front views, respectively, the mounting of a motor means to the structural frame means and to the assembly support means to provide automatic motion of the user engagement means in the side to side direction.
Figure 10B:
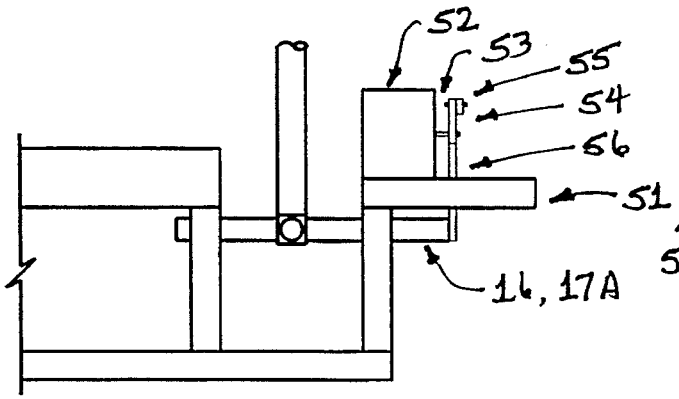
Figure 10C:
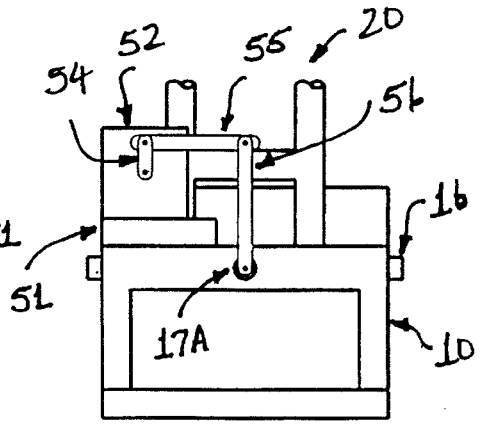

As seen in FIGS. 10A–10C, the motor and linkage assembly may be repositioned so that a rocker link 56 is now rigidly mounted to the main shaft-like member 17A of assembly support means 16. Therefore, as motor shaft 53 rotates, so will the crank link 54. Coupler link 55 will cause rocker link 56 to rock back and forth. This causes assembly support means 16 to turn backward and forward. Since user engagement means 20 is mounted on assembly support means 16, it will turn in the side to side direction.

Figure 11A:
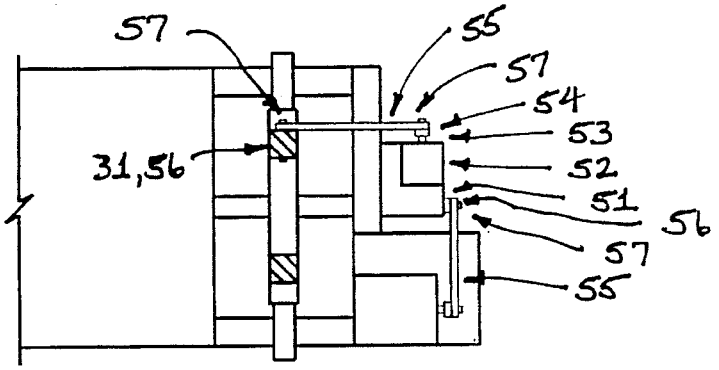
FIGS. 11A, 11B, and 11C demonstrate from the top, side, and front views, respectively, the mounting of two motors which may be used to automatically produce the forward and backward turning motion in the user engagement means simultaneously with the side to side turning motion.
Figure 11B:
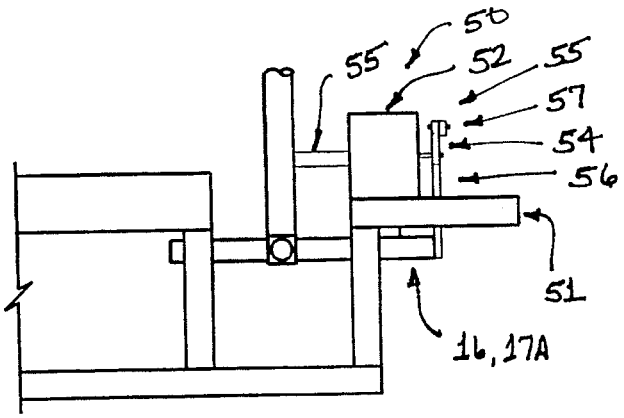
Figure 11C:
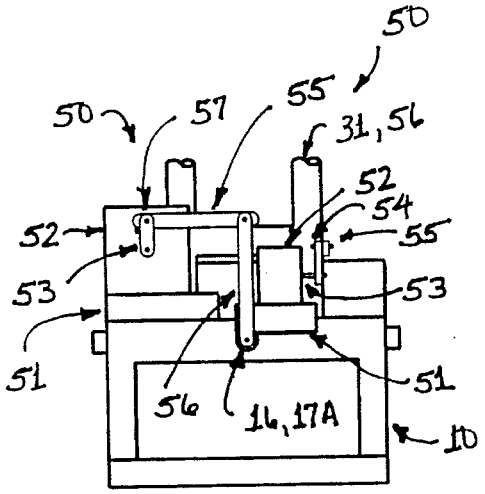

Operating two motor means simultaneously is possible, by having two motors mounted as shown in FIGS. 11A, 11B, and 11C. One motor mount is rigidly mounted to the horizontal frame support 13, while the second is mounted to the main shaft-like member 17A of assembly support means 16, and will turn in conjunction with the means. Therefore, as one motor means pivots the user engagement means 20 in the backward and forward direction, the second motor is simultaneously turning the user engagement means 20 in the side to side direction.

There are many modifications, variations, alterations, and combinations which may be made to the apparatus described in this application. Different types of structural frame means, user engagement means, assembly support means, resistance means, and motor means may be designed to serve the same described purposes. As shown, the device can be configured in different ways to perform different functions. Turning motion in the user engagement means can be limited to the backward and forward direction, limited to the side to side direction, or not limited so that it may move in both directions simultaneously. The resistance means and the motor means can operate with the turning motion of the user engagement means in either direction, or in both directions.

While it will be apparent that the preferred embodiment of the invention herein is well-calculated to fulfill the objects above stated, it will be appreciated that the invention is susceptible to modification, variation, and change without departing from its proper scope or fair meaning of the subjoined claims.

I claim:

1. An exercise apparatus comprising;

a structural frame means comprising a rigid frame, a back support means mounted at a substantially horizontal position on said rigid frame, and an assembly support means turnably coupled to said rigid frame; and a user engagement means comprising at least one upwardly extending support member turnably coupled near its lower end to said assembly support means of said structural frame means in such a manner that the turning motion of said support member is generally perpendicular to the turning motion of said assembly support means, and an engagement member mounted near the top of said support member, whereby a user may position themselves in a relatively reclined position upon said back support means of said structural frame means, engage said engagement member of said user engagement means with the general thigh portion of the legs, and turn said user engagement means in the forward, backward, and side directions.

2. The exercise apparatus as claimed in claim 1, wherein said user engagement means further comprises a coupling means mounted near the bottom of said support member for turnably coupling said support member of said user engagement means to said assembly support means of said structural frame means.

3. The exercise apparatus as claimed in claim 2, said coupling means comprising a sleeve member rigidly mounted to said support member.

4. The exercise apparatus as claimed in claim 3, wherein said assembly support means comprises a main shaft member turnably coupled to said rigid frame of said structural frame means such that said assembly support means may be turned in the forward and backward directions, and an extension member rigidly mounted to said main shaft member at a substantially perpendicular position and sized to loosely fit within the hollows of said sleeve member of said user engagement means such that said user engagement means may be turned in the side directions.

5. The exercise apparatus as claimed in claim 1, wherein said engagement member of said user engagement means comprises front, back, and side lower body supports.

6. The exercise apparatus as claimed in claim 1, further comprising a resistance means operatively connected to said user engagement means for producing a resistance force against the forward or backward motion of said user engagement means.

7. The exercise apparatus as claimed in claim 6, said resistance means comprising;

a resistance mount mounted to said user engagement means and having an internally threaded opening;

an externally threaded shaft turnably supported by said threaded opening;

a knob member rigidly mounted to the top of said threaded shaft;

a circular member rigidly mounted to said assembly support means of said structural frame means;

a friction belt loosely connected at one end to said threaded shaft and extending around a portion of the periphery of said circular member, whereby turning said knob in one direction will tighten said friction belt around said circular member causing an increase in the resistance to the turning motion of said user engagement means in the forward or backward direction, and turning said knob member in the opposite direction loosens said friction belt and causes a decrease in resistance.

8. The exercise apparatus as claimed in claim 7, said circular member being a flywheel.

9. The exercise apparatus as claimed in claim 1, further comprising a resistance means operatively connected to said user engagement means for producing a resistance force against side motion of said user engagement means.

10. The exercise apparatus as claimed in claim 9, said resistance means comprising;

a resistance mount mounted to said structural frame means and having an internally threaded opening;

an externally threaded shaft turnably supported by said threaded opening;

a knob member rigidly mounted to the top of said threaded shaft;

a circular member rigidly mounted to said user engagement means;

a friction belt loosely connected at one end to said threaded shaft and extending around a portion of the periphery of said circular member, whereby turning said knob in one direction will tighten said friction belt around said circular member causing an increase in the resistance to the turning motion of said user engagement means in the side directions, and turning said knob member in the opposite direction loosens said friction belt and causes a decrease in resistance.

11. The exercise apparatus as claimed in claim 10, said circular member being a flywheel.

* * * * *